US006044993A

United States Patent [19]

Yang

[11] Patent Number: 6,044,993

[45] Date of Patent: Apr. 4, 2000

[54] SEALABLE CONTAINER

[76] Inventor: Heng-Te Yang, P.O. Box 90, Tainan City, Taiwan

[21] Appl. No.: 09/157,754

[22] Filed: Sep. 22, 1998

[51] Int. Cl.[7] ..... B65D 43/16

[52] U.S. Cl. ..... 215/237; 220/835; 220/849

[58] Field of Search ..... 220/833–835, 220/840, 842, 849, 792, 795; 215/235, 237, 245; 222/556, 572

[56] References Cited

U.S. PATENT DOCUMENTS

| | | | |
|---|---|---|---|
| 232,730 | 9/1880 | Knowles | 215/235 |
| 1,482,724 | 2/1924 | Baron | 215/235 |
| 2,129,873 | 9/1938 | Romati et al. | 220/849 X |
| 2,797,840 | 7/1957 | Gibbs | 220/840 |
| 2,950,847 | 8/1960 | Tupper | 222/556 X |
| 3,172,130 | 3/1965 | Lange | 220/840 X |
| 5,320,232 | 6/1994 | Maguire et al. | 220/849 X |
| 5,738,238 | 4/1998 | Yang | 220/849 X |

*Primary Examiner*—Nathan J. Newhouse

[57] ABSTRACT

A sealable container includes a container body and a cap and an annular gasket. The container body has a pivot base with a pivot to fit in two pivot grooves of a pivotal base of the cap so as to make the cap swing up and down to close on or be opened from the container body. A annular gasket is fitted in an annular groove in an inner surface of the cap to seal a top edge of the container body when the cap is closed on the container body. The container body further has a projecting ridge in an opposite side of the pivot base to engage a projecting edge formed in the annular groove of the cap to keep the cap from being opened from the container body.

1 Claim, 6 Drawing Sheets

SEALABLE CONTAINER

BACKGROUND OF THE INVENTION

This invention relates to a sealable container, and particularly to one having a simple structure which facilitates making and using the container.

A known conventional sealable container shown in FIGS. 1 and 2, includes a container body 10, a clamping ring 11, a cap 12, anti-leak gasket 13, and a position ring 14 combined together.

The container body 10 has an annular groove 100 in an outer upper portion for the clamping ring 11 to fit in.

The clamping ring 11 has two clamping projections 110 with a hole 111 at one side, and a hook 112 combined with a pulling means 113 movably attached at the other side of the clamping projections 110.

The cap 12 has an annular groove 120 for the position ring 14 to fit therein.

The anti-leak gasket 13 is placed under the cap and on an upper end of the container body 10.

The position ring 14 has two ears 140 at two ends and a hook 141 formed in the other side of the ears 140. The two ears 140 are inserted through the holes 111 of the clamping projections 110 of the clamping ring 11.

In using the conventional sealable container, firstly, the hook 112 of the clamping ring 11 is swung up and hooks the hook 141 of the position ring 14, and then the pulling means 113 is pulled down. Thus the cap 12 may be closed up the container body 10 to seal the container body 10.

This construction has the disadvantages that the components of the conventional sealable container are made of different materials, which may result a large cost for a maker, and in addition, the conventional sealable container has a rather complicated structure for manufacture, which increases assembling time.

SUMMARY OF THE INVENTION

This invention has been devised to offer a sealable container having a simple structure to make and assemble.

The main feature of the invention is the container body having a pivot base with a pivot at an upper outer surface near a top edge, and a cap having an annular groove for fitting an annular gasket therein, a pivotal base with two pivot grooves fixed at one side for engaging the pivot of the container body so as to make the cap swingable up and down to open or close the container body, and a projecting edge provided in the annular groove to to engage a projecting ridge of the container body to keep the cap from opening when the cap is closed on the container body. An annular gasket may seals any aperture between the cap and the container body when the cap is closed on the container body.

BRIEF DESCRIPTION OF DRAWINGS

This invention will be better understood by refering to the accompanying drawings, wherein.

DETAILED DESCRIPTION OF THE PREFERRED EMBODIMENT

Figure 1:
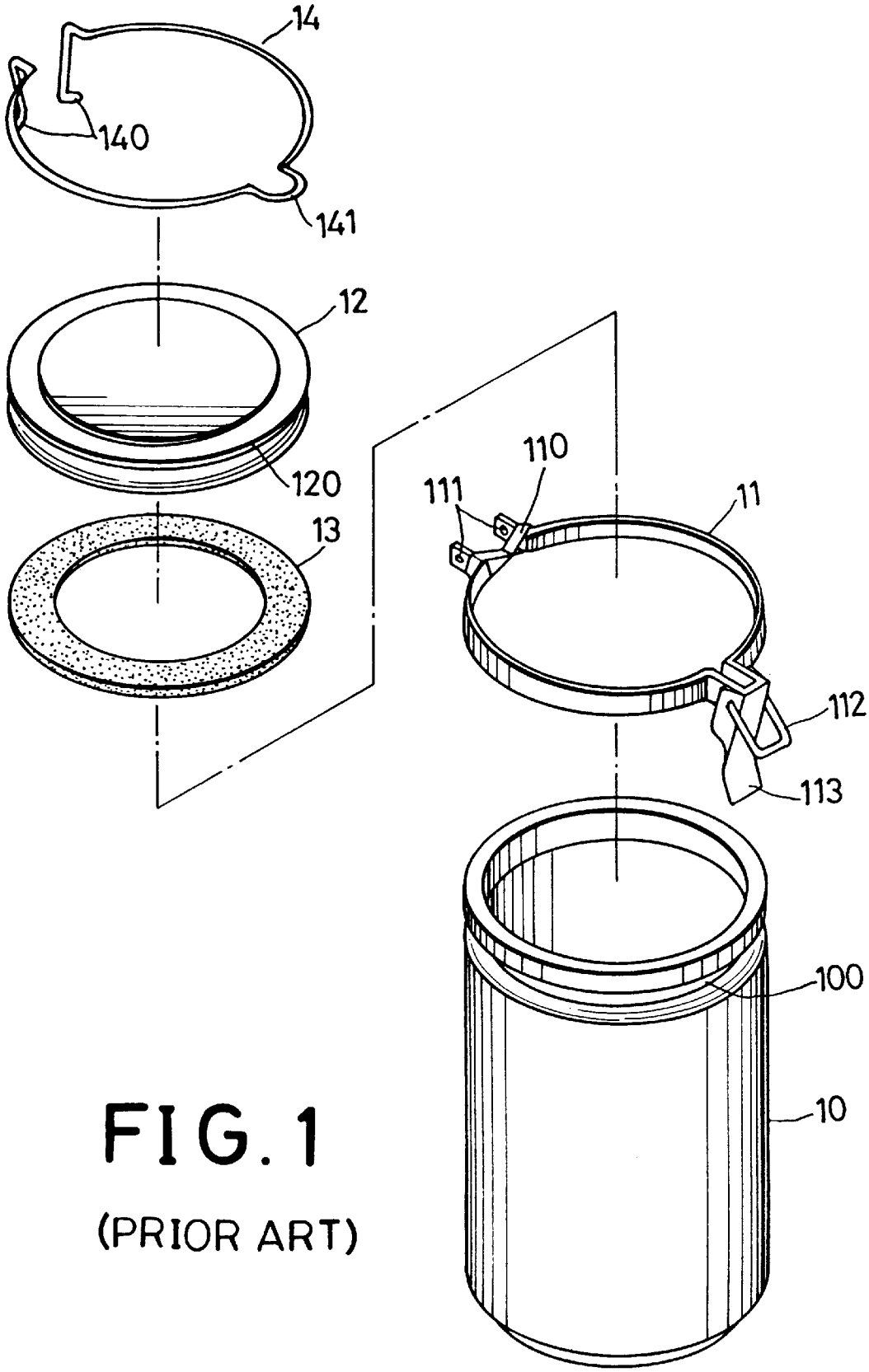
FIG. 1 (PRIOR ART)
FIG. 1 is an exploded perspective view of a known conventional sealable container.
Figure 2:
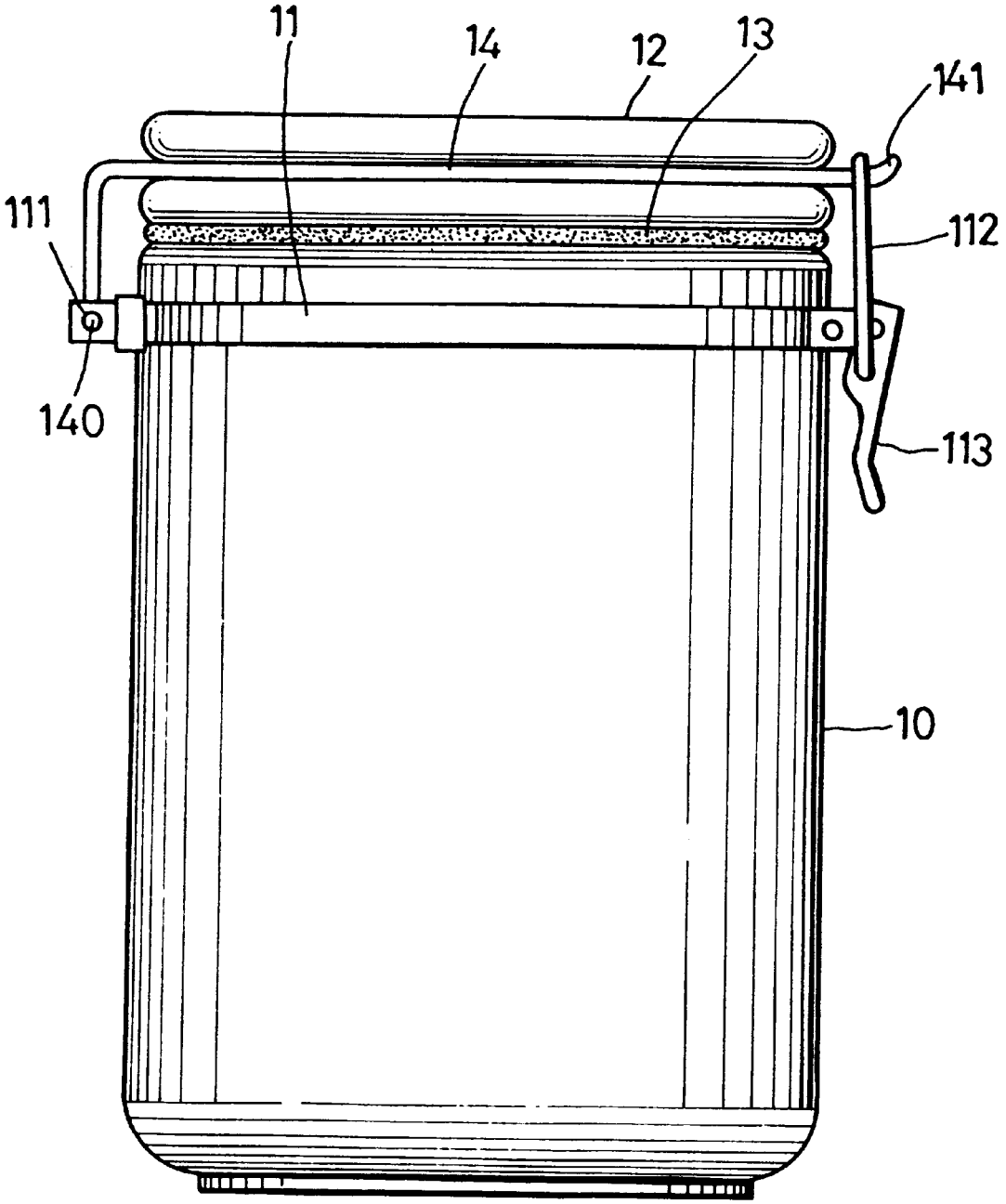
FIG. 2 (PRIOR ART)
FIG. 2 is a side view of the known conventional sealable container.
Figure 3:
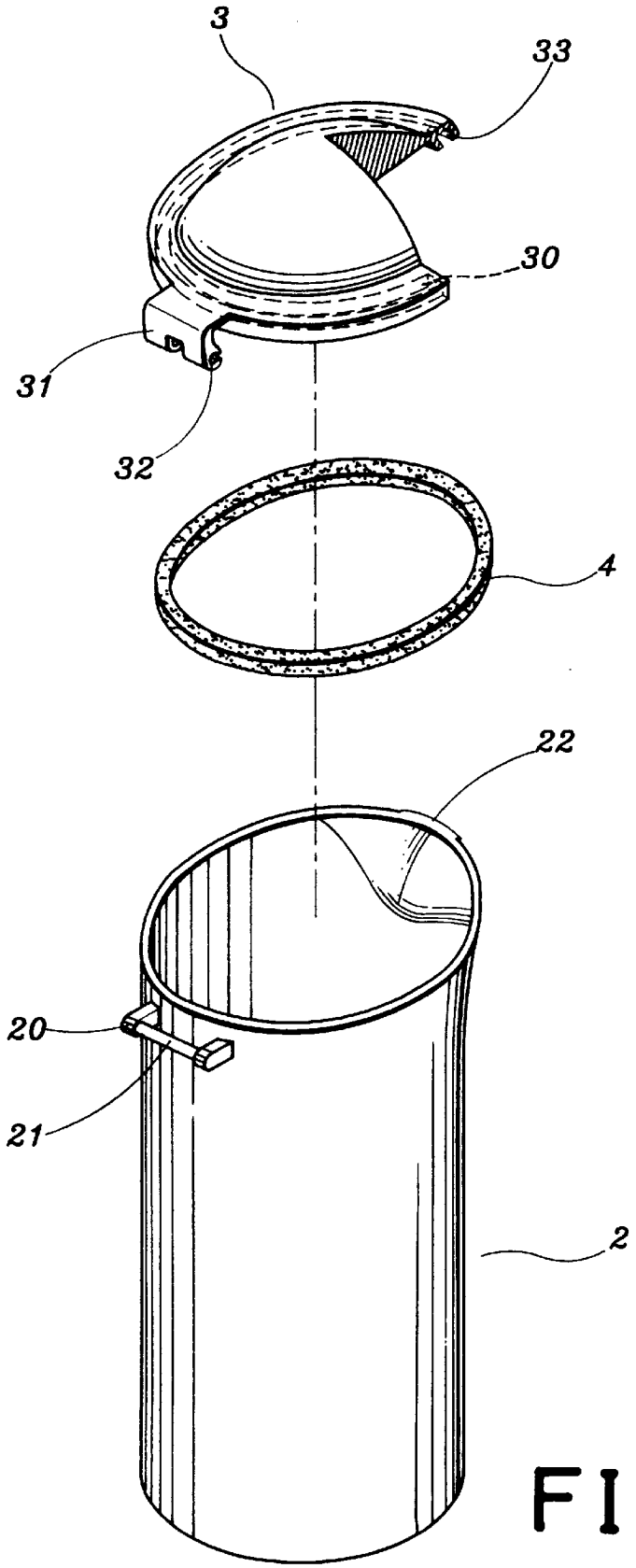
FIG. 3 is an exploded perspective view of a sealable container in the present invention.
Figure 4:
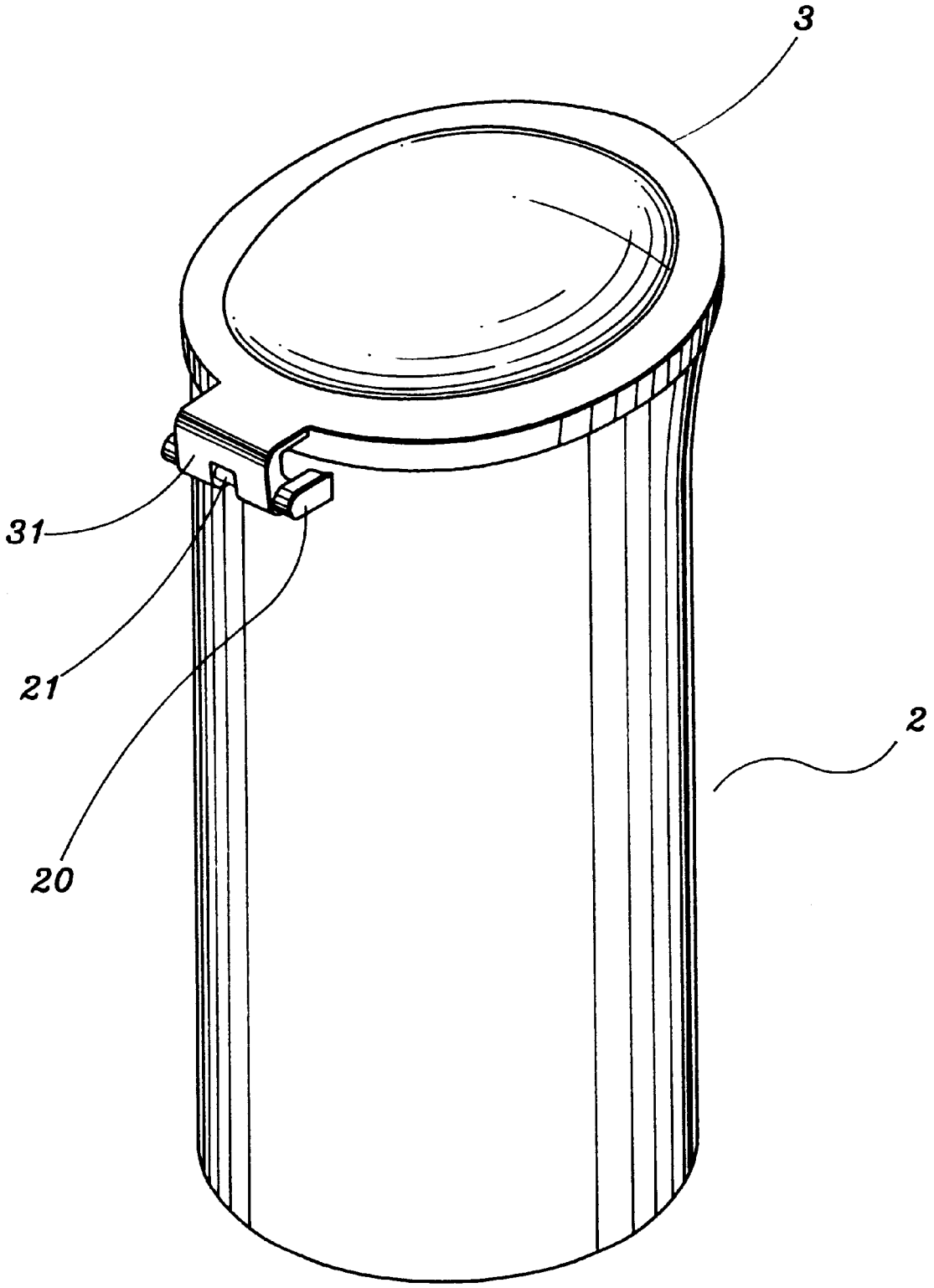
FIG. 4 is a perspective view of the sealable container in the present invention.

A preferred embodiment of a sealable container in the present invention, as shown in FIGS. 3 and 4, includes a container body 2, a cap 3 and an annular gasket 4 as main components combined together.

The container body 2 has a pivot base 20 at an upper outer surface near a top edge, and a projecting-out ridge 22 on an opposite side of the pivot base 20. The pivot base 20 has a horizontal pivot 21 between two studs fixed on the outer surface.

The cap 3 closes on the top edge of the container body 2, having an annular groove 30 formed in an inner surface, and a pivotal base 31 formed with two pivot grooves 32 to engage with the pivot 21 of the pivot base 20 of the container body 2. The cap 3 further has a projecting edge 33 extending inward from a wall of the annular groove 30 at an opposite side of the pivotal base 31.

The annular gasket 4 fits in the annular groove 30, made of rubber.

Figure 5:
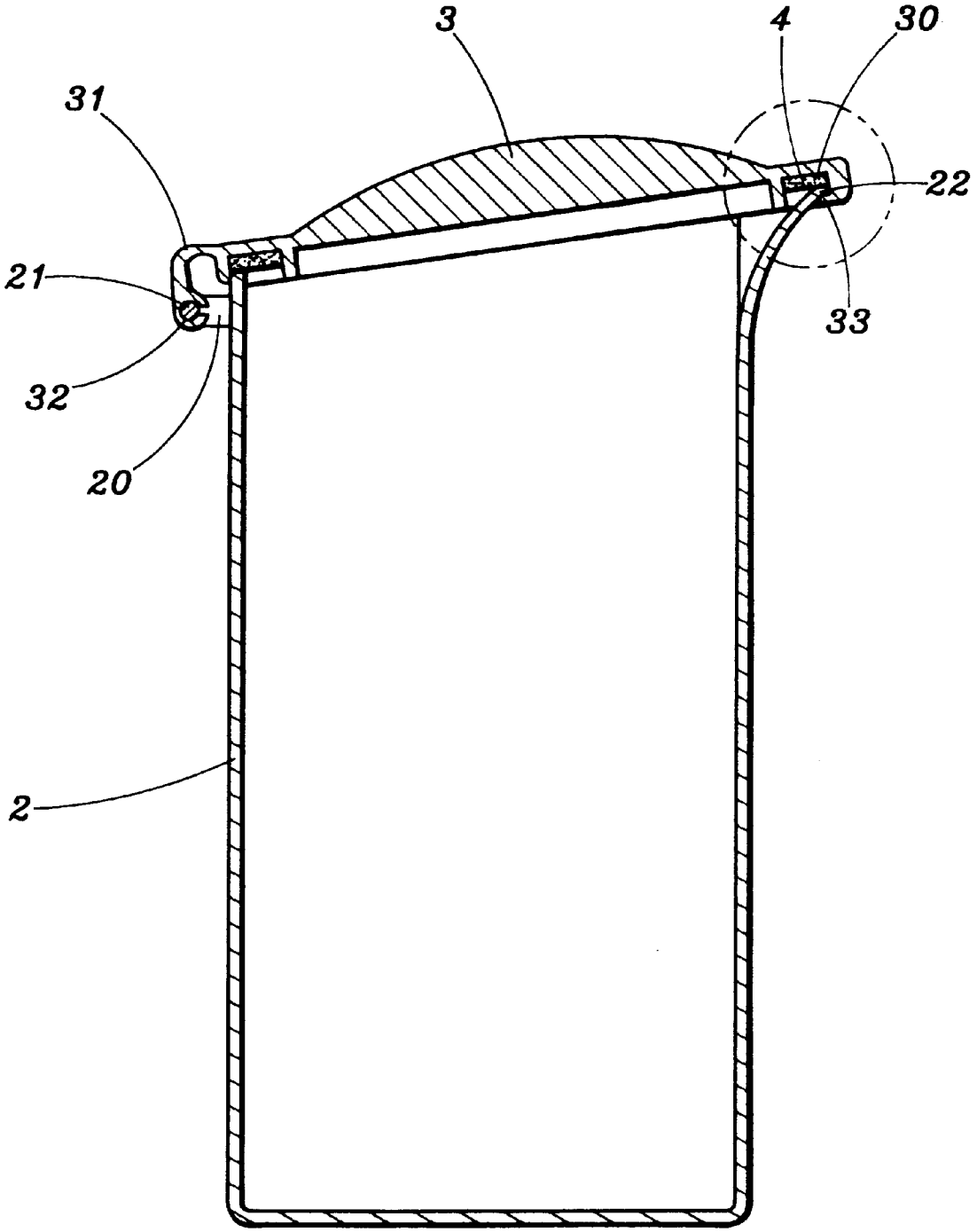
FIG. 5 is a cross-sectional view of the sealable container in the present invention; and, FIG. 6 is an enlarged partial cross-sectional view of the engaging portion of a cap and a container body in the present invention.

In assembling, referring to FIGS. 3 and 5, firstly, the annular gasket 4 is inserted in the annular groove 30 of the cap 3, and next, the pivotal base 31 is combined with the pivot base 20 of the container body 2, with the two grooves 32 engaging the pivot 21, pivotally connecting the cap 3 to the container body 2. Thus, assembling of the sealable container is finished very quickly.

Figure 6:
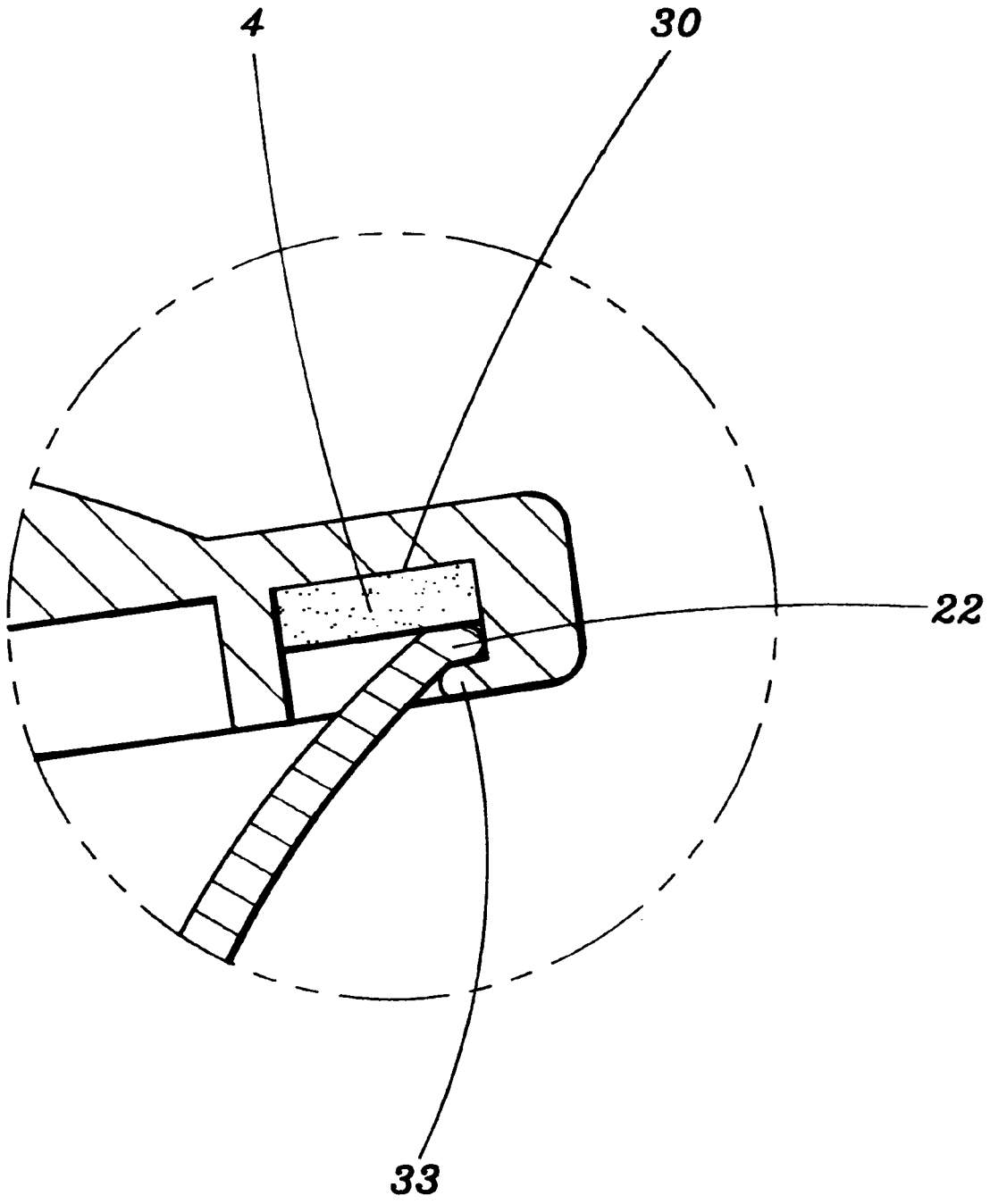

In using, referring to FIGS. 3 and 5, fresh food to be preserved in the container is placed in the container body 2, with the cap 3 opened. Then cap 3 is closed on the container body 2, pressing the cap 3 forcibly to let the projecting edge 33 of the cap 3 engage the projecting ridge 22 of the container body 2, as shown in FIGS. 5 and 6. Then the annular gasket 4 may seal any aperture between the cap 3 and the container body 2, preventing air from flowing into the container body 2. Therefore, food kept in the container may be preserved fresh for a long period of time.

If the cap 3 is wanted to be opened, the engaged point of the cap 3 and the container body 2, i.e. the point where the projecting edge 22 engages the projecting edge 33 is forcibly pushed open, and the cap 3 is freed. So it is very easy to handle.

As can be seen from the aforesaid description, the sealed container in the invention has the following advantages:

1. Its manufacturing process may be simplified, with its cost lowered.
2. It is easy to assemble and can effectively attain the object of preserving food fresh.
3. It has a simple structure, and is convenient to use.

While the preferred embodiment of the invention has been described above, it will be recognized and understood that various modifications may be made therein and the appended claims are intended to cover all such modifications which may fall within the spirit and scope of the invention.

What is claimed is:

1. A sealable container comprising a container body, a cap, and an annular gasket, said container body having a pivot base fixed on an outer upper surface near a top edge on a first side of said container body, said pivot base having a horizontal pivot, and said container body further including a projecting-out ridge formed in a second side of said container body opposite said first side, said cap closing on said container body and having an annular groove in an inner surface for receiving said annular gasket and a pivotal base having two pivot grooves arranged to engage said pivot of said pivot base of said container body to let said cap swing up and down by means of said pivot, a projecting edge extending inwardly from a wall of said annular groove of said cap for engaging said projecting ridge, said projecting ridge extending into said annular groove between said gasket and said inwardly extending projecting edge to establish a seal and keep said cap from moving.

* * * * *